US005228612A

United States Patent [19]

Kuo et al.

[11] Patent Number: 5,228,612

[45] Date of Patent: Jul. 20, 1993

[54] TAPE DISPENSER WITH A SLIDING TAPE AXLE

[75] Inventors: Long-Far Kuo; Janey Lee, both of Taipei, Taiwan

[73] Assignee: Wen-hao Chang, Taipei, Taiwan

[21] Appl. No.: 853,615

[22] Filed: Mar. 18, 1992

[51] Int. Cl.[5] ..... B26F 3/02

[52] U.S. Cl. ..... 225/47; 225/77; 225/90

[58] Field of Search ..... 225/46, 47, 80, 90, 225/26, 77; 242/55.53

[56] References Cited

U.S. PATENT DOCUMENTS

| | | | |
|---|---|---|---|
| 2,776,095 | 1/1957 | Emmert | 225/47 |
| 3,403,869 | 10/1968 | Marchisen et al. | 225/47 |
| 4,059,210 | 11/1977 | Deering, Jr. | 225/47 |
| 4,752,023 | 6/1988 | Lin | 225/26 |

FOREIGN PATENT DOCUMENTS

| | | | |
|---|---|---|---|
| 0256449 | 10/1989 | Japan | 242/55.53 |

*Primary Examiner*—Hien H. Phan

*Attorney, Agent, or Firm*—Harrison & Egbert

[57] ABSTRACT

This invention, a tape dispenser with a sliding tape axle, is designed to eliminate the problem and disturbance of a loosened or missing tape axle of traditional tape dispensers with separate parts joined together. It uses a structure that fastens the tape axle and the base together. Its tape axle is a cylindrical body with a pair of sliding slots on one side to match a pair of horizontal tenons on a sunken surface of the base, and a pair of tenons at its bottom surface to fix the tape axle into an insertion slot in the sunken surface on one end and a sunken rim on the other side of the tape compartment, restricting the horizontal movement of the tape axle and avoiding its loosening from the base, and thus forming a tape dispenser with a sliding tape axle.

6 Claims, 5 Drawing Sheets

FIG. 3A
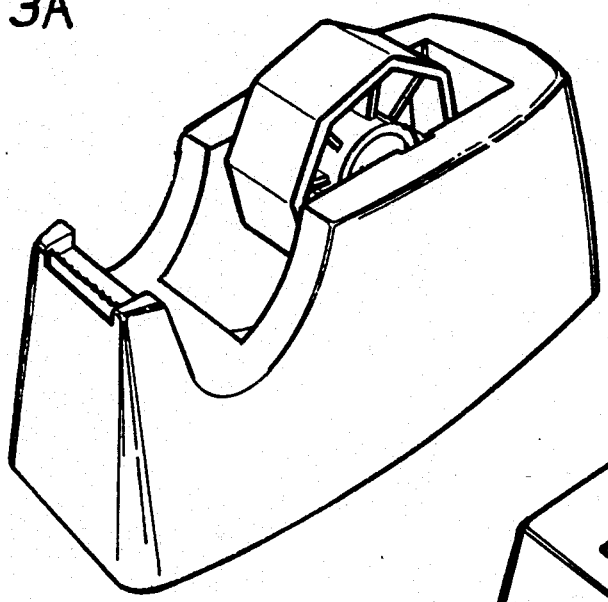
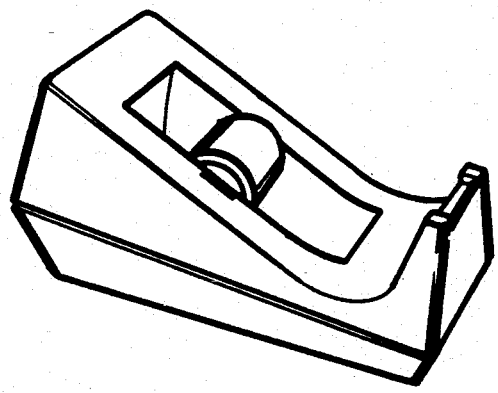
FIG. 3B
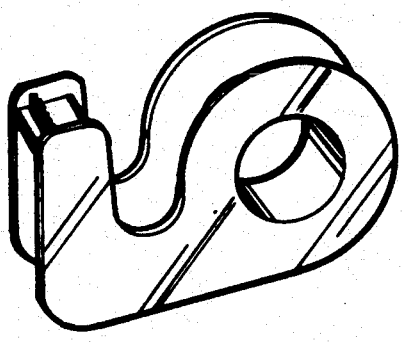
FIG. 3C

TAPE DISPENSER WITH A SLIDING TAPE AXLE

BACKGROUND OF THE INVENTION

As tape is simple, clean and convenient to use, it is commonly used in the world. Because of its popularity, tapes with different width, length and material were developed for different applications and purposes, and tape dispensers for different types of tapes were introduced as a result. To suit different types of tapes, tape dispensers were designed in different structures and types. The most popularly used tape dispensers are illustrated by (A) of FIG. 3. This type of tape dispenser has a structure shown by FIG. 4. It has a tape compartment (11') on a base (1') with two grooves (12',12a') extending downwards from the top of the tape dispenser to act as mortises to accommodate two shafts (21') on both sides of a tape axle (2'), a cutting device (13') in the front edge of the tape dispenser to cut the tape (3) after the tape head (31) is pulled to a desired length by the rotation of the axle mounted on the base. As tape axle and base of traditional tape dispensers are separate parts joined together, the tape axis often falls off or lost, causing a big disturbance in use.

PRIOR ART OF THE INVENTION

As illustrated in FIG. 5, a tape dispenser (of 3M brand) commonly seen in the market is composed mainly of a base and a pillar-shape device, which can be inserted into and pulled out from a vertical slot on the side wall of a tape compartment vertically, to hold the tape. The tape can be dispensed after the pillar-shape device is pressed into the vertical slot. As the insertion and removal of the pillar-shape device isn't smooth and the arm is often broken or damage as a result, the design is not perfect. However, as this type of tape dispenser has been mass produced and widely used, it is obvious that tape dispenser without rotating tape axle is functionable.

FIELD OF THE INVENTION

The main purpose of this invention is to offer a new tape dispenser that eliminates the problem and disturbance of missing or damaging tape axle, and to provide a new tape dispenser with simple and convenient operation.

SUMMARY OF THE INVENTION

The characteristics of this invention is a tape dispenser with a sliding tape axle. It consists of a base (with a tape compartment at the back and a cutting device in the front edge) and a tape axle, with details as follows:

One side of the tape compartment is a sunken surface that has a pair of horizontal tenons on the sunken surface, an insertion slot on the inner edge of the sunken surface, and a sunken rim on the opposite side of the tape compartment.

The tape axle is a cylindrical body that has a sliding slot to match the sliding tenons on the sunken surface. It also has a pair of tenons to let the tape axle rest horizontally on the sunken rim on the other side of the tape compartment, while the other tenon fixed in the insertion slot on the inner edge of the sunken surface, limiting the horizontal movement of the tape axle to leave the base.

BRIEF DESCRIPTION OF THE DRAWINGS

The following drawings are attached to present the invention clearly for a better understanding of the structure and operation of this invention:

FIGS. 3A, 3B and 3C show traditional tape dispensers.

NOMENCLATURE (1, 1') Tape Dispenser
(2, 2') Tape Axle
(3) Tape
(11, 11') Tape Compartment
(12',12a') Grooves
(13, 13') Cutting Device
(14) Sunken Surface
(15, 15a) Horizontal Tenons
(16) Insertion Slot
(17) Sunken Rim
(21) Sliding Slot
(21') Shaft
(22, 23) Tenons
(31) Tape Head

DETAILED DESCRIPTION OF THE PREFERRED EMBODIMENT

Figures 1, 1A:
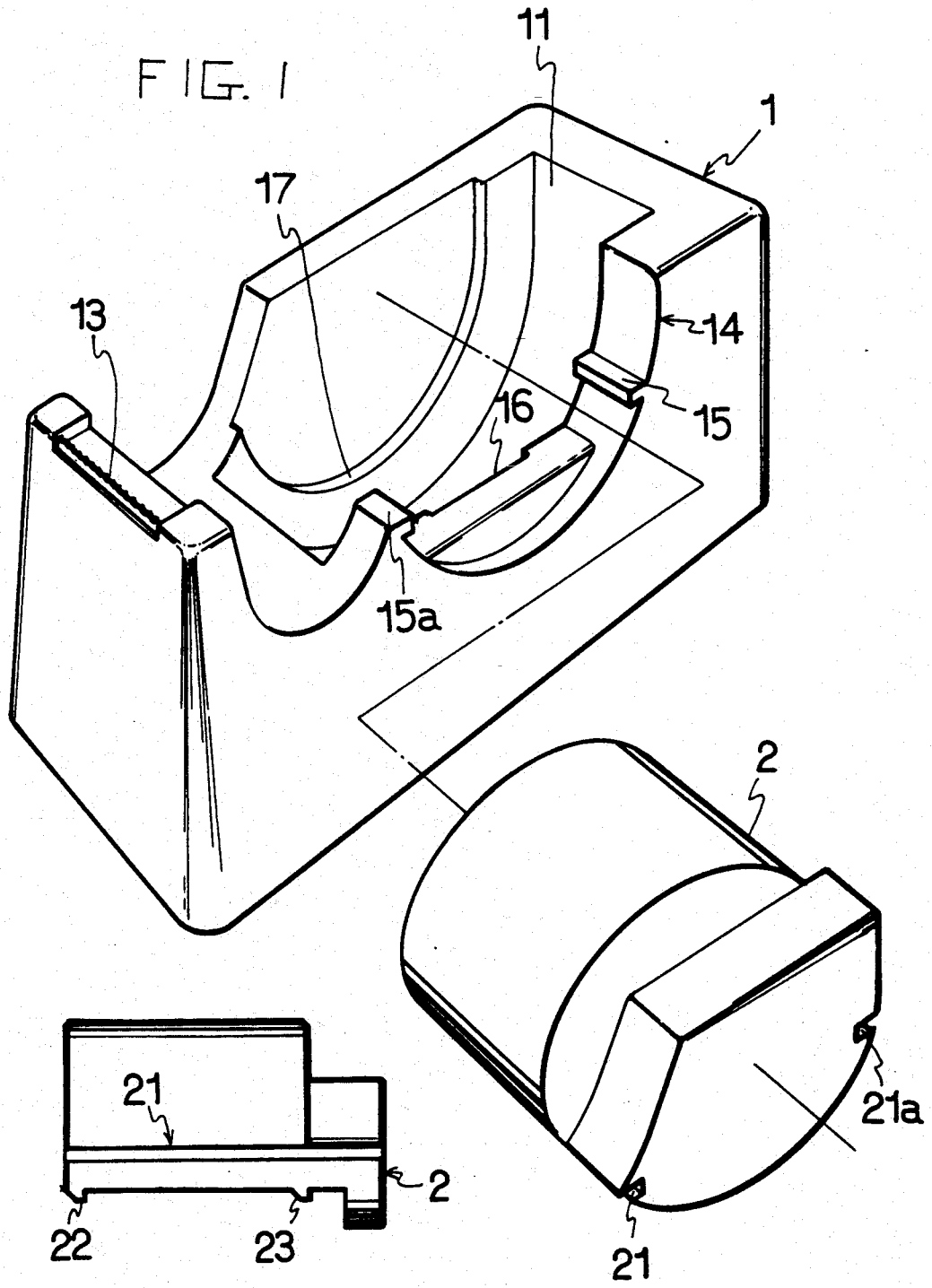
FIG. 1 is the analytical drawing for an example of this invention.
FIG. 1A is a side view of the tape axle of the present invention.

As shown by FIG. 1, this invention is formed mainly by a base (1) and a tape axle (2). The base (1) has a tape compartment (11) to accommodate the tape axle, and can be added with a sawlike cutting device (13) in its front edge. One side of the tape compartment (11) has a specially designed sunken surface (14) installed with a pair of horizontal tenons (15,15a) in a suitable position, and an insertion slot (16) in the sunken surface. The other side of the tape compartment (11) has a sunken rim (17) corresponding to the sunken surface (14). The tape axle (2) is a cylindrical body that has a pair of sliding slots (21) on one side to match with the pair of horizontal tenons (15,15a) on the sunken surface (14), and a pair of tenons (22,23) at the bottom to match the width of the tape compartment (11').

The tape axle (2) can be mounted to the base (1) by sliding it down along the sliding slots (21) of tis surface and the horizontal tenons (15,15a) of the sunken surface (14) on one side of the tape compartment (11), making it hangs over the tape compartment (11) and joins to the sunken rim (17) on the other side of the tape compartment (11). The tape axle (2) is fixed in the tape compartment (11) by the insertion of tenons (22,23) under the tape axle (2) into the insertion slot (16) in the sunken surface (14), limiting the horizontal movement of the tape axle (2), avoiding its loosening from the base (1), and forming a tape dispenser with a sliding tape axle.

Figure 2:
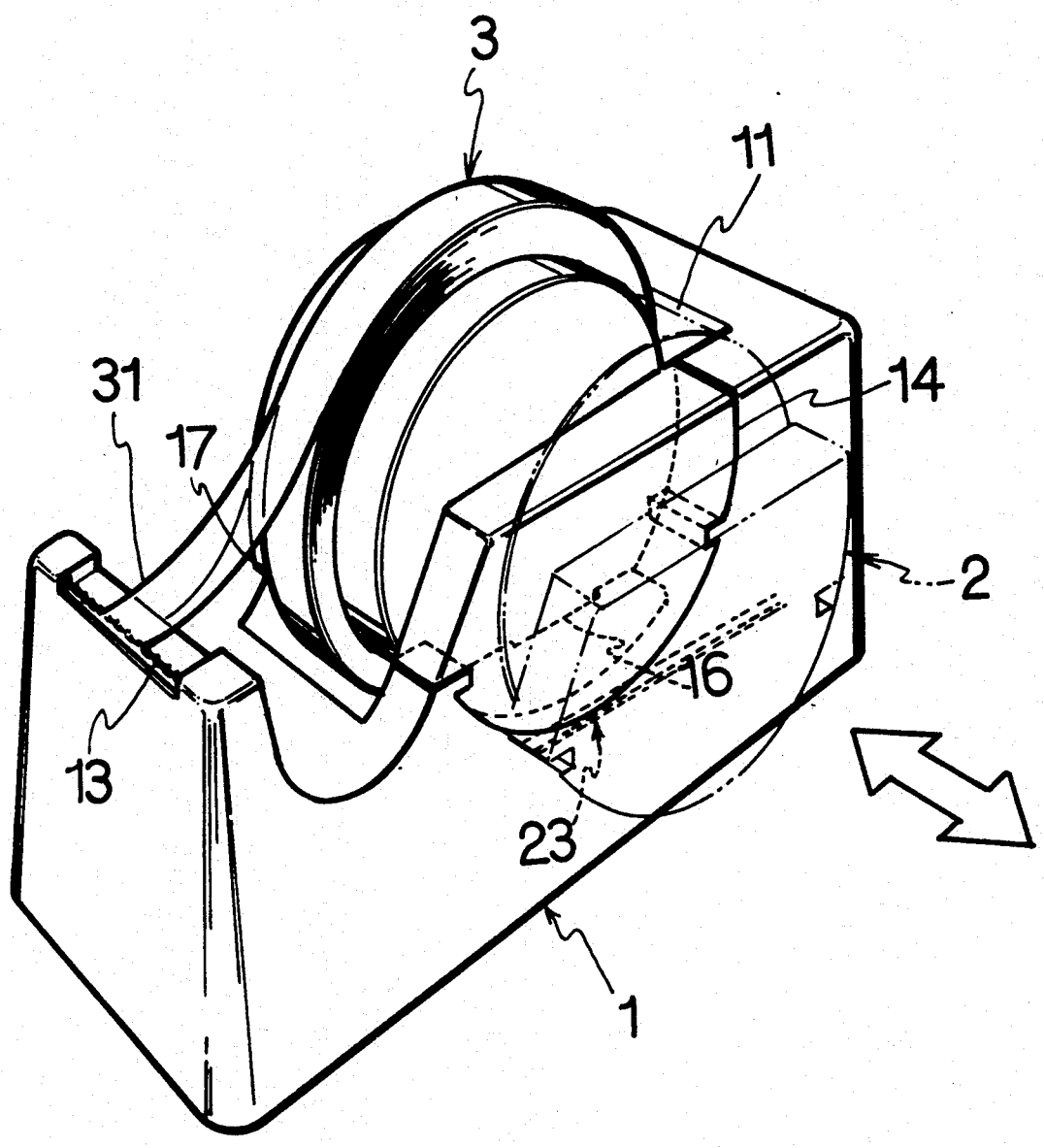
FIG. 2 is the illustrate drawing for an example of this invention.
Figure 4:
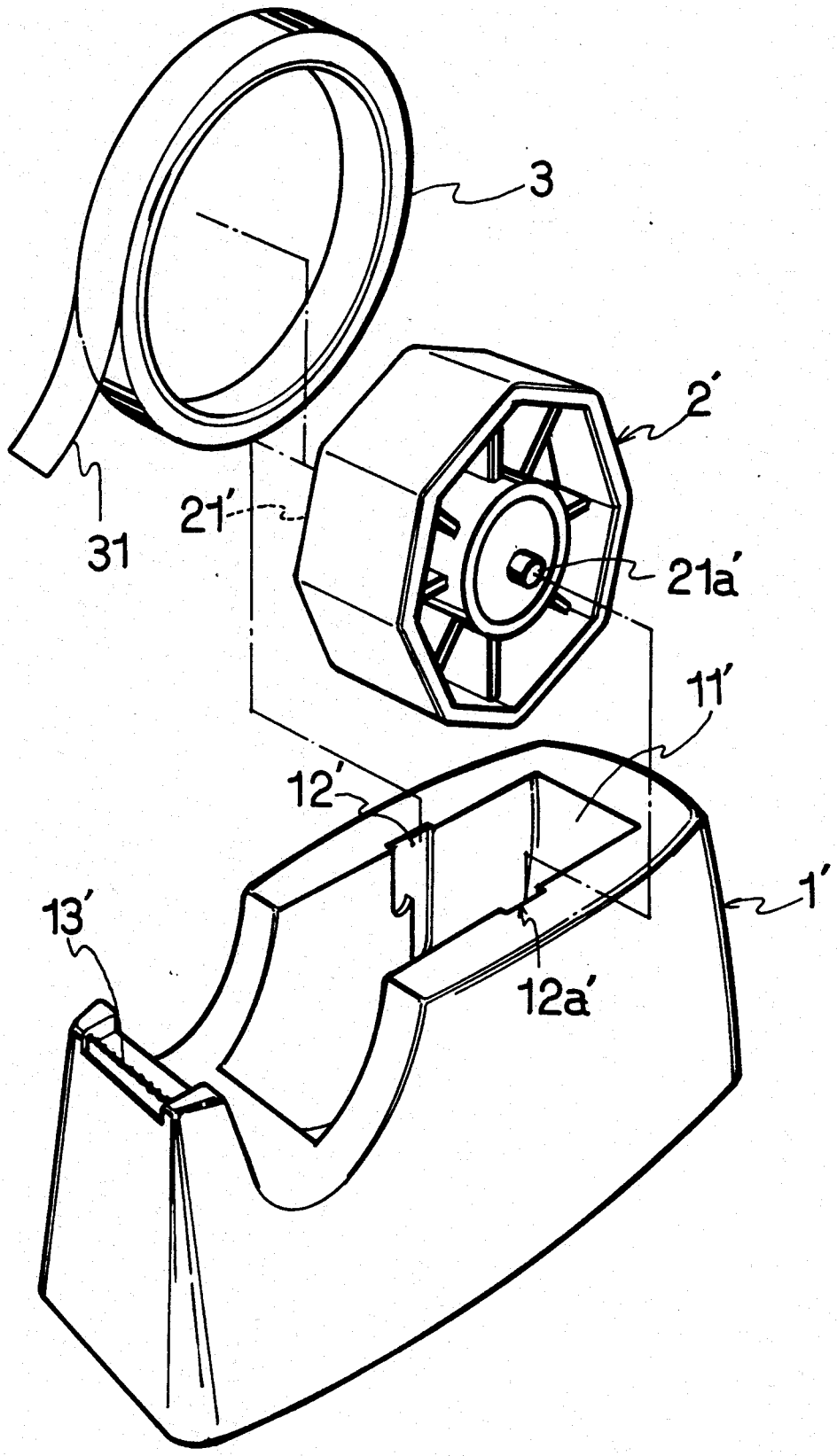
FIG. 4 illustrates the structure of a traditional tape dispenser.
Figure 5:
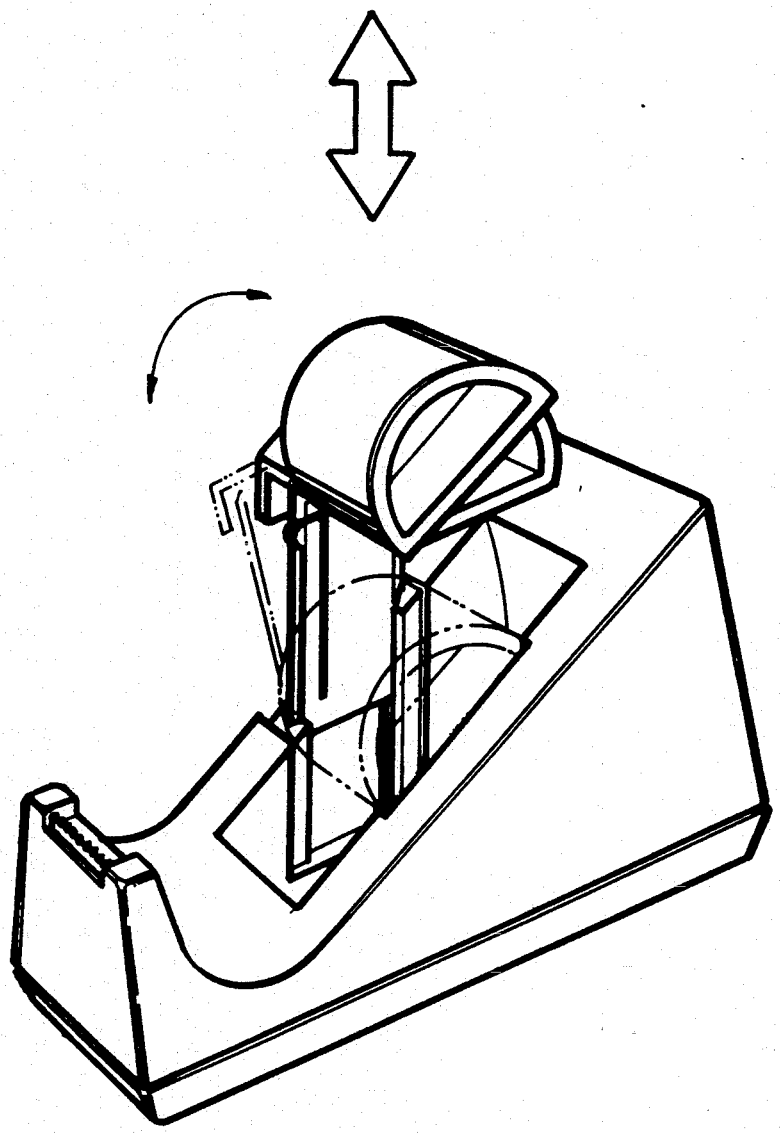
FIG. 5 is the analytical drawing for this new tape dispenser.

As shown by FIG. 2, the tape axle (2) can be pulled side way by a sliding motion to make it loosen from the sunken rim (17) on the opposite side of the tape compartment (11). After a tape (3) is mounted onto the tape axle (2), slide the tape axle (2) back to the sunken rim

(17) and make the tenons (22,23) stuck into the insertion slot (16) on the sunken surface (14) to fix it. Pull out the tape head (31), and make use of the cutting device (13) to cut the tape into desired length. The replacement of tape and the operation is simple and convenient by the use of this invention.

Although this tape dispenser does not have a rotating axle for the tape, it does not hinder the use of tape. As this invention is practical in function and uses a new structure, The present invention is a worthy improvement over the conventional tape dispenser.

What is claimed as now is as following:

1. A tape dispenser comprising:

a base having a tape compartment therein and a cutting edge positioned distal said tape compartment, said tape compartment having a sunken surface formed therein, said sunken surface having at least one horizontal tenon extending therefrom, said tape compartment having an insertion slot formed therein adjacent to said sunken surface, said tape compartment having a sunken rim formed on a side of said tape compartment opposite said sunken surface, said sunken surface corresponding to a position of said sunken rim; and a tape axle having a cylindrical body with at least one sliding slot extending axially along a peripheral surface of said cylindrical body, said sliding slot engageable with said horizontal tenon so as to support said tape axle within said insertion slot of said tape compartment.

2. The tape dispenser of claim 1, said tape axle having at least one tenon on a bottom thereof, said tenon affixed within said insertion slot of said tape compartment.

3. The tape dispenser of claim 2, said tape axle having a pair of tenons formed thereon, one of said tenons adjacent said sunken surface of said tape compartment, another of said tenons adjacent said sunken rim of said tape compartment.

4. The tape dispenser of claim 2, said base having a pair of horizontal tenons formed on opposing surfaces of said sunken surface.

5. The tape dispenser of claim 4, said tape axle having a pair of sliding slots slidable onto said horizontal tenons of said tape compartment.

6. The tape dispenser of claim 1, said tape axle for receiving a roll of tape, said tape axis being nonrotatable within said insertion slot.

* * * * *